US006694897B2

(12) United States Patent
Lou-Hao

(10) Patent No.: US 6,694,897 B2
(45) Date of Patent: Feb. 24, 2004

(54) TABLE

(75) Inventor: Leng Lou-Hao, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/313,177

(22) Filed: Dec. 6, 2002

(65) Prior Publication Data

US 2003/0121459 A1 Jul. 3, 2003

(30) Foreign Application Priority Data

Dec. 8, 2001 (CN) ..... 01268946
Dec. 29, 2001 (CN) ..... 01280168

(51) Int. Cl.[7] ..... A47B 3/00
(52) U.S. Cl. ..... 108/132; 108/161
(58) Field of Search ..... 108/132, 131, 108/129, 161, 901, 57.25, 133, 115; 248/188.6, 188.8

(56) References Cited

U.S. PATENT DOCUMENTS

| | | | | |
|---|---|---|---|---|
| 2,680,662 A | | 6/1954 | Adler | |
| 2,730,418 A | | 1/1956 | Blink | |
| 2,921,825 A | | 1/1960 | Spiegel | |
| 3,143,982 A | | 8/1964 | Blink et al. | |
| 3,416,486 A | | 12/1968 | Peterson et al. | |
| 3,661,100 A | | 5/1972 | Tennant | |
| 3,777,675 A | | 12/1973 | Hanusiak | |
| 4,111,482 A | | 9/1978 | Jones | |
| 4,727,816 A | * | 3/1988 | Virtue | 108/91 |
| 5,271,338 A | * | 12/1993 | Bonham | 108/161 |
| 5,284,100 A | | 2/1994 | Thorn | |
| 5,357,872 A | | 10/1994 | Wilmore | |
| 5,394,808 A | | 3/1995 | Dutro et al. | |
| 5,540,158 A | | 7/1996 | Ford | |
| 5,623,882 A | * | 4/1997 | Price | 108/129 |
| 5,638,760 A | * | 6/1997 | Jordan et al. | 108/57.25 |
| 5,732,637 A | * | 3/1998 | Raab | 108/129 |
| 5,983,807 A | * | 11/1999 | Tarnay et al. | 108/132 |
| 6,032,585 A | | 3/2000 | Pinch | |
| 6,058,853 A | * | 5/2000 | Pinch | 108/129 |
| 6,112,674 A | | 9/2000 | Stanford | |
| 6,371,034 B1 | * | 4/2002 | Simpson et al. | 108/129 |
| 6,508,184 B1 | * | 1/2003 | Winter et al. | 108/129 |
| 6,520,094 B2 | * | 2/2003 | Wen | 108/132 |
| 6,530,331 B2 | * | 3/2003 | Stanford | 108/132 |

FOREIGN PATENT DOCUMENTS

JP 2000-50963 * 2/2000

* cited by examiner

*Primary Examiner*—Jose V. Chen
(74) *Attorney, Agent, or Firm*—Barnes & Thornburg

(57) ABSTRACT

A table includes a leg anchor. The leg anchor is coupled to a leg of the table and is embedded in a core of a table top to couple the leg thereto. The core is positioned in an interior region of a shell of the table top. A lower shell member of the shell provides an underside of the table top and includes a rim and a stiffening rib arrangement that cooperate to provide a channel for receiving the leg.

25 Claims, 5 Drawing Sheets

TABLE

Foreign priority is hereby claimed under 35 U. S. C. §119 to Chinese Patent Application No. 01268946.7 filed in the People's Republic of China on Dec. 8, 2001 and Chinese Patent Application No. 01280168.2 filed in the People's Republic of China on Dec. 29, 2001, the disclosures of which are hereby incorporated by reference herein.

BACKGROUND

The present disclosure relates to tables. In particular, it relates to support and strengthening of components of tables.

Tables typically include a table top and one or more legs to support the table top. There are a variety of ways to mount the legs to support the table top. In some cases, the legs are arranged so as to be fixed against movement relative to the table top. In other cases, the legs are arranged for movement between, for example, use and storage positions.

SUMMARY

According to the present disclosure, a table includes a leg anchor for anchoring a table leg to a table top. The table top includes a shell and a core. The core is positioned in an interior region of the shell to strengthen the table top. The leg anchor is coupled to the leg and embedded in the core to anchor the leg to the table top. Illustratively, the leg anchor includes an undulating member and flanges extending therefrom in the core. The core fills channels formed in the undulating member.

According to an aspect of the disclosure, the shell includes upper and lower shell members that provide the interior region. The lower shell member provides an underside of the table top and includes a stiffening rib arrangement and a rim coupled to the upper shell member. The stiffening rib arrangement and the rim cooperate to provide an elongated channel to receive the leg.

Additional features and advantages of the apparatus will become apparent to those skilled in the art upon consideration of the following detailed description exemplifying the best mode as presently perceived.

BRIEF DESCRIPTION OF THE DRAWINGS

The detailed description particularly refers to the accompanying figures in which.

DETAILED DESCRIPTION OF THE DRAWINGS

Figure 1:
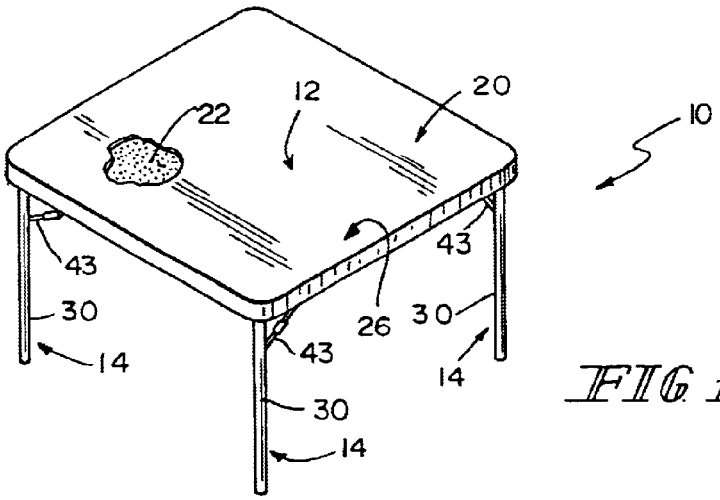
FIG. 1 is a perspective view, with portions broken away, showing a table including a table top supported by legs positioned in an extended position and showing the table top including a shell and a core inside the shell.
Figure 2:
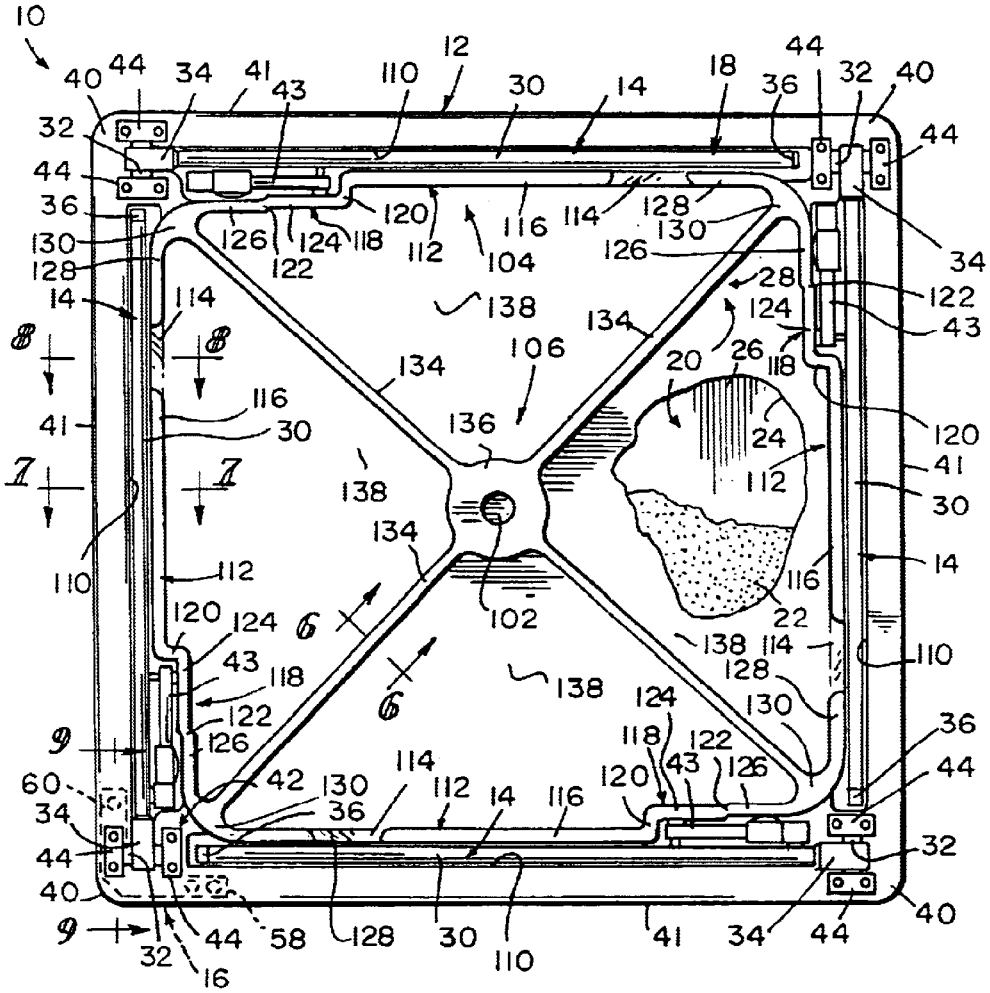
FIG. 2 is a bottom view of the table, with portions broken away, showing the legs positioned in a collapsed position and showing a monolithic lower shell member of the table top shell including a rim and a stiffening rib arrangement cooperating with the rim to provide leg-receiving channels receiving the legs.

A table 10 is shown, for example, in FIG. 1. The table 10 includes a table top 12 and a number of legs 14 (e.g., four) coupled to the table top 12 for movement between an extended, use position, as shown in FIG. 1, and a collapsed, storage position, as shown in FIG. 2. A leg anchor 16 shown, for example, in FIGS. 2, 4, 5, and 9 is used to couple each leg 14 to the table top, as discussed in more detail herein. Also discussed in more detail herein is a stiffening rib arrangement 18 formed in the table top 12 to strengthen the table top 12 and shown, for example, in FIG. 2.

The table top 12 includes a shell 20 and a core 22 that fills in an interior region 24 of the shell 20 to strengthen the table top 12, as shown, for example, in FIGS. 1–3 and 5–9. The shell 20 includes a monolithic upper shell member 26 (see FIGS. 1 and 3–9) and a monolithic lower shell member 28 (see FIGS. 2–9). The upper and lower shell members 26, 28 are coupled together and cooperate to provide the interior region 24. The members 26, 28 are made of, for example, acrylonitrile butadiene styrene The core 22 is made of, for example, urethane foam that is introduced into the interior region 24 and cures to provide the core 22, as discussed in more detail herein.

The table top 12 is illustratively shaped as a quadrilateral (e.g., a square), as shown in FIGS. 1 and 2. It therefore has four corner regions 40 and four sides 41. Each side 41 extends between two of the corner regions 40.

The legs 14 are similar to one another in structure and function. Each leg 14 is coupled to one of the corner regions 40 of the table top 12 by a leg mounting mechanism 42, as shown in FIGS. 2, 4, 5, and 9. The leg mounting mechanisms 42, which include the leg anchors 16, are also similar to one another in structure and function. Thus, the following discussion of one of the legs 14 and one of the leg mounting mechanisms 42 is applicable to the other legs 14 and leg mounting mechanisms 42 as well.

Figure 3:
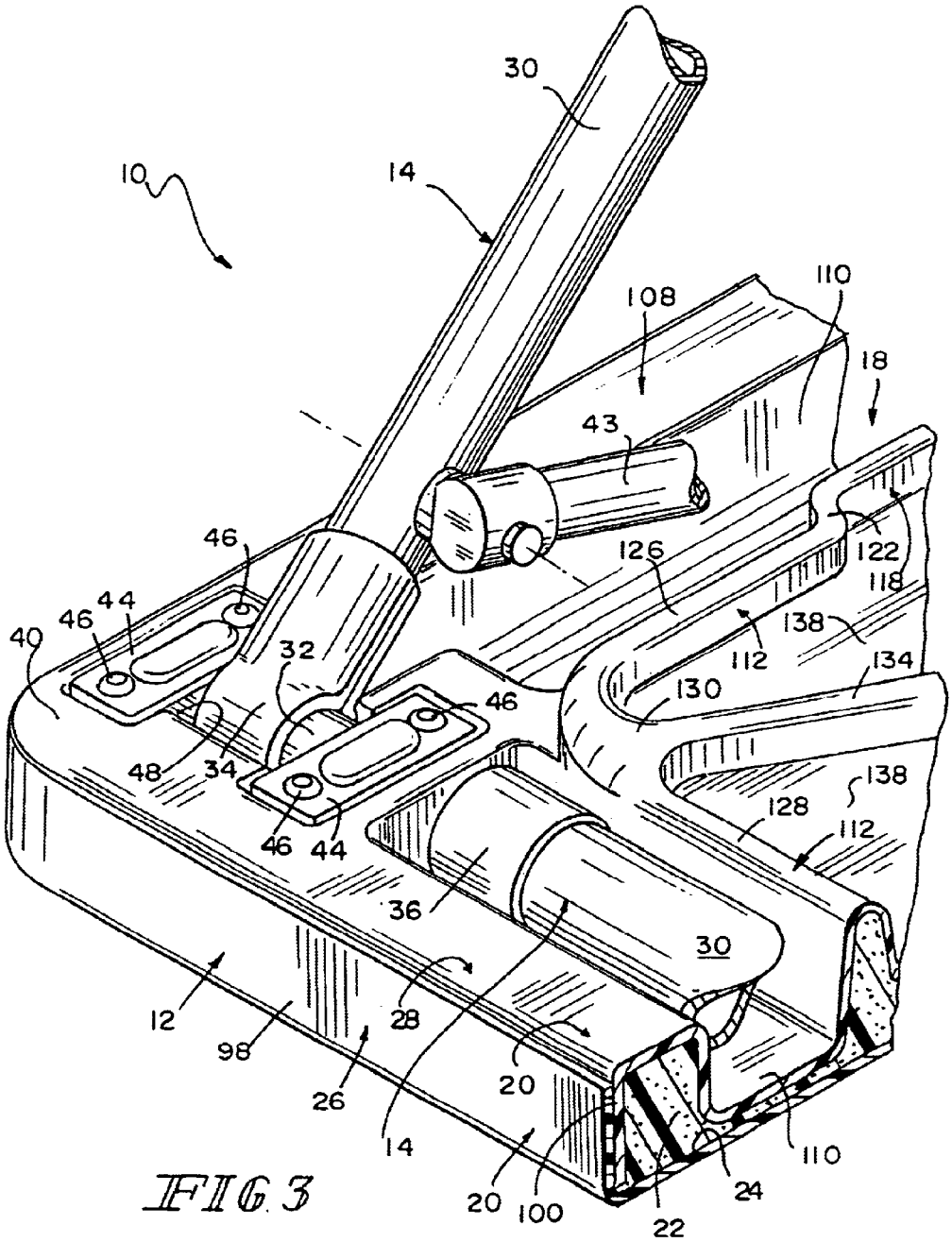
FIG. 3 is an enlarged perspective view showing one of the legs positioned between its extended and collapsed positions so as to extend outside of an associated leg-receiving channel formed in the lower shell member.
Figure 4:
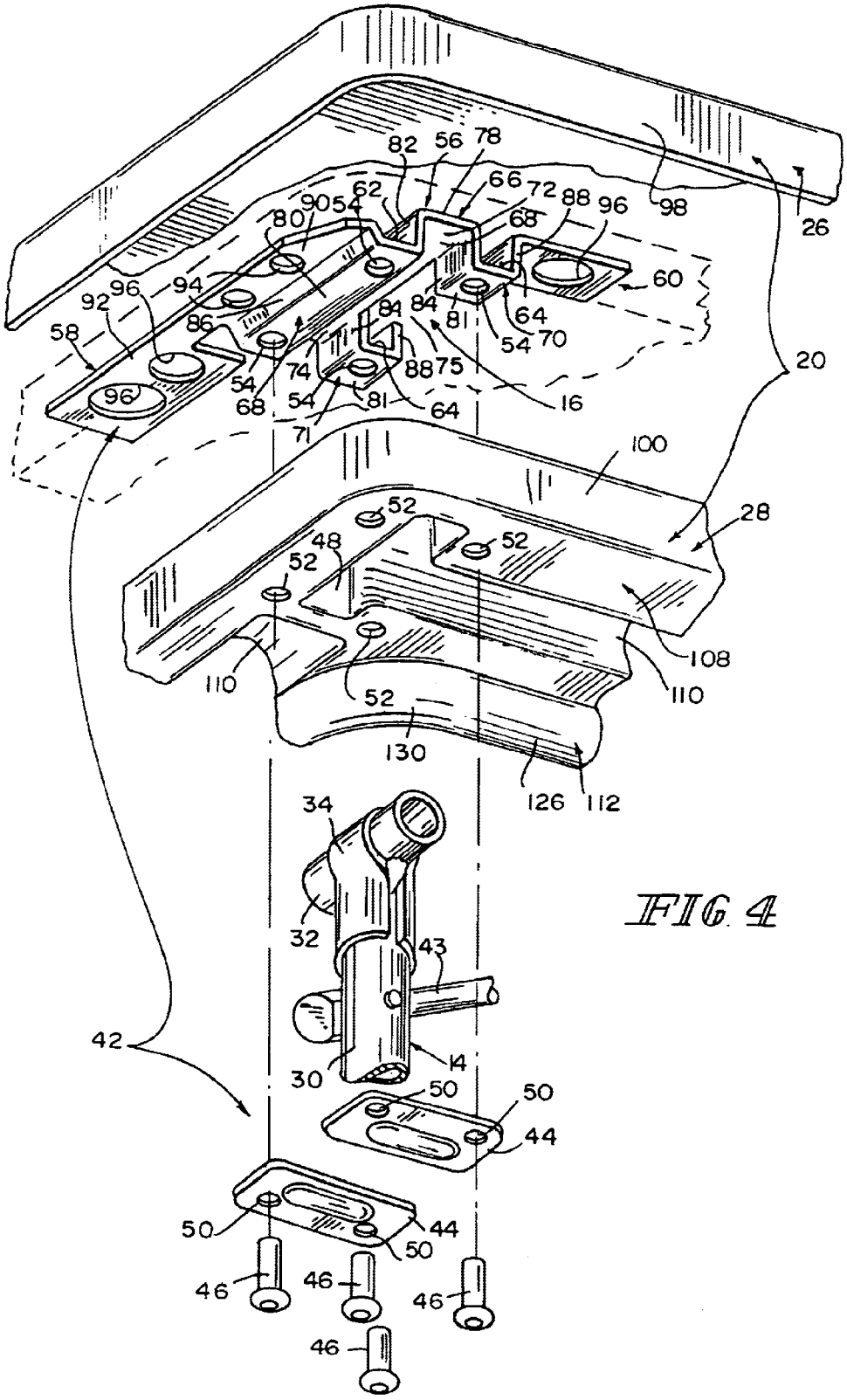
FIG. 4 is an exploded perspective view showing one of the leg anchors located between upper and lower shell members of the table top shell and other components for mounting one of the legs to the table top.
Figure 5:
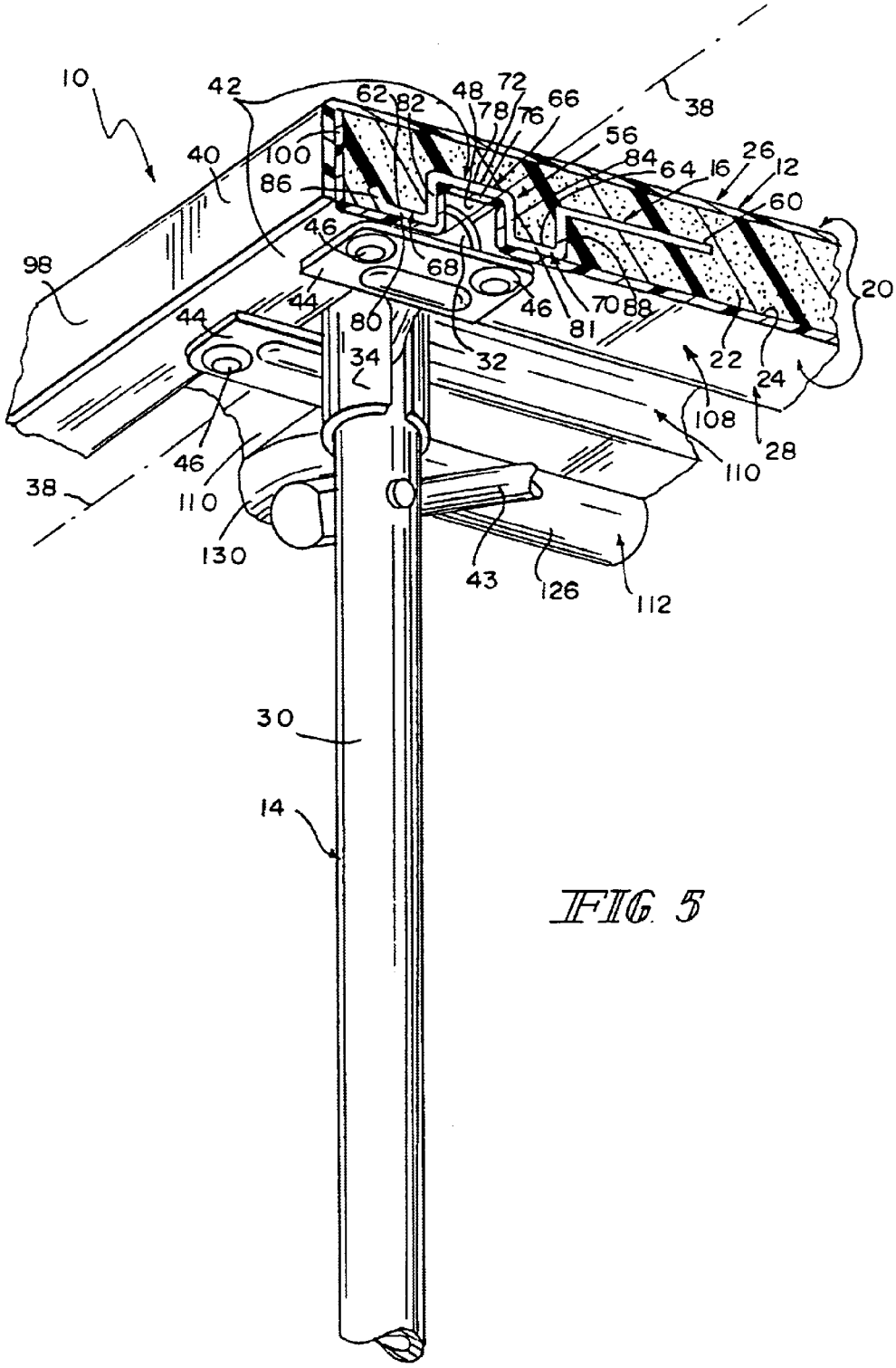
FIG. 5 is a perspective view showing the leg anchor of FIG. 4 embedded in the core of the table top and showing the leg associated with the leg anchor in its extended position.
Figure 8:
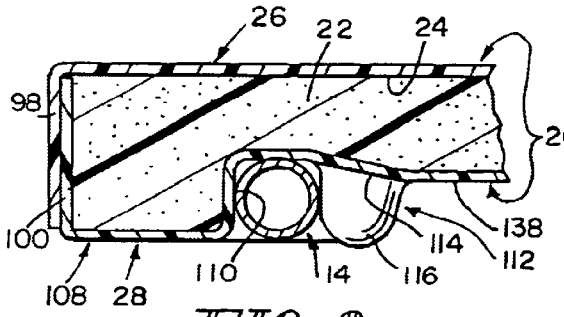
FIG. 8 is a sectional view taken along lines 8—8 of FIG. 2 showing the leg of FIG. 7 located in its leg-receiving channel and an access opening to the right of the leg to facilitate access thereto.
Figure 6:
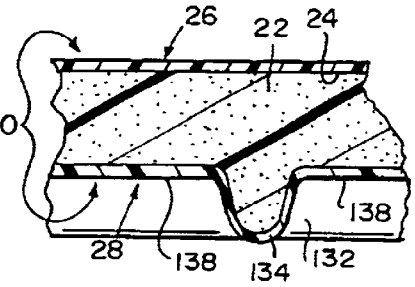
FIG. 6 is a sectional view taken along lines 6—6 of FIG. 2 showing a stiffening rib formed in the lower shell member.
Figure 7:
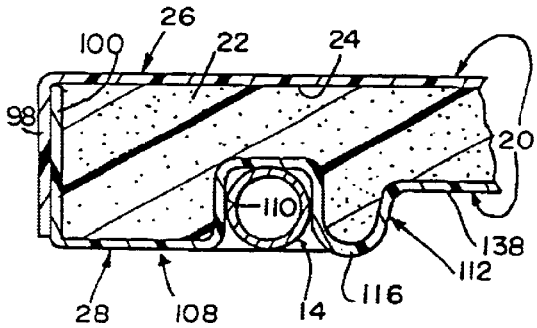
FIG. 7 is a sectional view taken along lines 7—7 of FIG. 2 showing a leg located in a leg-receiving channel formed in the lower shell member.

The leg 14 includes an elongated pole 30, a pivot 32 perpendicular to the pole 30, and a sleeve 34 receiving and coupled to the pivot 32 and an upper end of the pole 30, as shown, for example, in FIGS. 3–5. A foot 36 is attached to a lower end the pole 30 for engagement with a floor (not shown). The pivot 32 is coupled to the table top 12 by the leg mounting mechanism 42 for pivotable movement of the pole 30 about a pivot axis 38 (see FIG. 5) between its extended, use and collapsed, storage positions. A leg lock 43 is coupled to the leg 14 and the lower shell member 28 for releasably locking the leg 14 in its extended, use position, as shown, for example, in FIGS. 1–5.

The leg mounting mechanism 42 includes a pair of brackets 44, a pair of fasteners 46 associated with each bracket 44, and a leg anchor 16, as shown, for example, in FIGS. 4 and 5. Each bracket 44 extends over an end portion of the pivot 32 and is coupled to the leg anchor 16 by the associated pair of fasteners 46 to retain the pivot 32 in a recessed portion 48 (see FIGS. 4, 5, and 9) of the lower shell member 28. The fasteners 46 are, for example, rivets (as shown in the drawings), screws, bolts, or the like. The fasteners 46 extend through fastener-receiving apertures 50 (see FIG. 4) formed in the brackets 44, fastener-receiving apertures 52 (see FIG. 4) formed in the lower shell member 28, and fastener-receiving apertures 54 (see FIG. 4) formed in the leg anchor 16.

Figure 9:
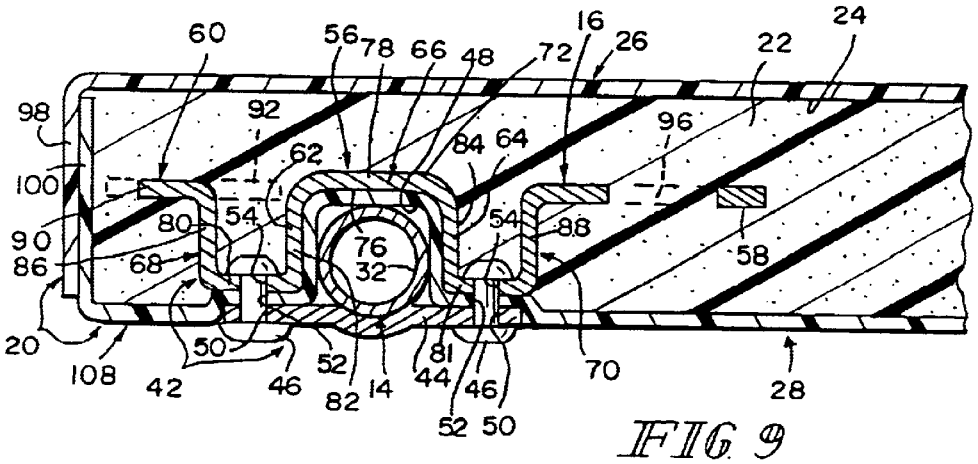
FIG. 9 is a sectional view taken along lines 9—9 of FIG. 2 showing a leg anchor embedded in the core of the table top to anchor one of the legs to the table top.

The leg anchor 16 is positioned in the interior region 24 and is embedded in the core 22 to anchor the leg 14 to the table top 12, as shown in FIGS. 5 and 9. The leg anchor 16 takes the form of a plate, for example, and includes an undulating member 56, a larger flange 58, and a smaller flange 60, as shown in FIGS. 4 and 9. The undulating member 56 has undulations that mate with the recessed portion 48 of the lower shell member 28 and are embedded in the core 22. The flanges 58, 60 extend from the undulating member 56 into the core 22 in different directions (e.g., 90° from one another as suggested in FIG. 1), somewhat like roots in soil. Thus, the undulating member 56 and the flanges 58, 60 anchor the leg 14 to the table top 12.

The undulations of the undulating member 56 take the form of an central ridge 66, a larger trough 68, and a pair of spaced-apart smaller troughs 70, 71, as shown in FIGS. 4, 5, and 9. The larger trough 68 extends laterally from one side of the ridge 66. The smaller troughs 70, 71 extend laterally from an opposite side of the ridge 66. The smaller trough 70 extends from a first end portion 72 of the ridge 66. The smaller trough 71 extends from a second end portion 74 of the ridge 66. The smaller troughs 70, 71 are spaced apart from one another to provide a space 75 therebetween to receive the leg 14 in its collapsed, storage position.

The ridge 66 and troughs 68, 70, 71 are formed to include channels, as shown in FIGS. 4, 5, and 9. A lower surface of the ridge 66 is formed to include a channel 76 that mates with the recessed portion 48 and receives the pivot 32. An upper surface of the larger trough 68 is formed to include a core-receiving channel 62 filled by the core 22. An upper surface of each of the smaller troughs 70, 71 is formed to include a core-receiving channel 64 filled by the core 22.

The ridge 66 and troughs 68, 70, 71 have oppositely-shaped cross-sections. The ridge 66 has an inverted U-shaped cross-section. The troughs 68, 70, 71 have a U-shaped cross-section.

The undulating member 56 includes a series of walls that provide the ridge 66 and troughs 68, 70, 71, as shown in FIGS. 4, 5, and 9. The undulating member 56 includes a central upper wall 78, a larger lower wall 80, and a pair of smaller lower walls 81. The walls 78, 80, 81 are generally parallel to one another. The undulating member 56 further includes a larger inner wall 82, a pair of smaller inner walls 84, a larger outer wall 86, and a pair of smaller outer walls 88. The inner and outer walls 82, 84, 86, 88 are generally parallel to one another and perpendicular to the upper and lower walls 78, 80. The upper wall 78, the larger inner wall 82, and the smaller inner walls 84 provide the ridge 66. The larger outer wall 86, the larger inner wall 82, and the larger lower wall 80 provide the larger trough 68. Each smaller trough 70, 71 is provided by one of the smaller outer walls 88, one of the smaller inner walls 84, and one of the smaller lower walls 81. The lower walls 80, 81 of the troughs 68, 70, 71 are formed to include the fastener-receiving apertures 54 through which the fasteners 46 extend.

The larger flange 58 is coupled to and extends from the larger trough 68 in generally parallel relation to the upper and lower walls 78, 80, 81, as shown in FIGS. 4 and 9. The larger flange 58 includes a first portion 90 coupled to and extending from the larger outer wall 86 of the larger trough 68 and a second portion 92 that is wider than the first portion 90 and is coupled to and extends from the first portion 90. The first portion 90 is formed to include a pair of smaller apertures 94. The second portion 92 is formed to include a pair of larger apertures 96. The apertures 94, 96 permit the foam material of the core 22 to flow therethrough to both sides of the leg anchor 16 during introduction of the foam material into the interior region 24. When the material of the core 22 cures, it fills the apertures 94, 96 of the larger flange 58.

The smaller flange 60 is coupled to and extends from the smaller trough 70, as shown in FIGS. 4, 5, and 9. In particular, the smaller flange 60 is coupled to and extends from the smaller outer wall 88 of the smaller trough 70. The smaller flange 60 is about as wide as the second portion 92 of the larger flange 58 and is formed to include a larger aperture 96 to permit the foam material of the core 22 to flow therethrough to both sides of the leg anchor 16 during introduction of the foam material into the interior region 24. When the material of the core 22 cures, it fills the larger aperture 96 of the smaller flange 60.

During assembly of the table 10, the legs 14 and leg anchors 16 are coupled to one another and to the lower shell member 28 as discussed above with respect to one of the legs 14 and one of the leg anchors 16. The upper and lower shell members 26, 28 are then coupled together by, for example, a bonding agent such as glue to provide the shell 20. The bonding agent is used to couple peripheral walls 98, 100 of the upper and lower shell member 26, 28 together. Once the shell 20 is assembled, uncured foam material such as urethane is introduced into the interior region 24 of the shell 20 through a port 102 (see FIG. 2) formed in the lower shell member 28. The uncured foam material fills the empty spaces in the interior region 24 and engulfs the leg anchors 16. In doing so, it flows over the undulating member 56 and the flanges 58, 60 and through the flange apertures 94, 96 and fills the trough channels 62, 64 and the flange apertures 94, 96. When the foam material cures, it provides the core 22 which holds the leg anchors 16 embedded therein in place.

The stiffening rib arrangement 18 includes an outer stiffening rib arrangement 104 and an X-shaped inner stiffening rib arrangement 106 engaging the outer stiffening rib arrangement 104, as shown in FIG. 2. The inner stiffening rib arrangement 106 is surrounded by the outer stiffening rib arrangement 104. A rim 108 of the lower shell member 28 surrounds both the outer and inner stiffening rib arrangements 104, 106. The outer stiffening rib arrangement 104 cooperates with the rim 108 to provide an elongated leg-receiving channel 110 for each leg 14. Each leg 14 nests in one of the leg-receiving channels 110 when it is positioned in its collapsed position.

The outer stiffening rib arrangement 104 includes four stiffening ribs 112 aligned longitudinally with one another, as shown in FIG. 2. Two of the four ribs 112 cooperate with the rim 108 to provide each leg-receiving channel 110. Adjacent ribs 112 are spaced apart to provide an access opening 114 therebetween to facilitate access to an associated leg 14 when the leg 14 is located in its leg-receiving channel 110 in the collapsed position.

Each stiffening rib 112 includes an elongated portion 116 (see FIGS. 2, 7, and 8), an offset portion 118 (see FIGS. 2 and 3), and a corner portion 119 (see FIGS. 2–4). The portions 116, 118, 119 of each rib 112 extend end-to-end.

The elongated portion 116 is generally straight and parallel to one side 41 of the table top 12, as shown in FIG. 2. It cooperates with a corner portion 119 of an adjacent rib 112 to provide one of the access openings 114.

The offset portion 118 extends a short distance inwardly from the elongated portion 116. This is to widen an end of one of the leg-receiving channels 110 to make room for one of the leg locks 43 to enter the leg-receiving channel 110 upon movement of the leg 14 to which the leg lock 43 is coupled into the leg-receiving channel 110. The offset portion 118 includes first and second transition portions 120, 122 and an intermediate portion 124 extending between the transition portions 120, 122. The first transition portion 120 extends a short distance inwardly from an end of the elongated portion to the intermediate portion 124. The intermediate portion 124 extends from the first transition portion 120 to the second transition portion 122. The second transition portion 122 extends a short distance inwardly from the intermediate portion 124 to the corner portion 119. The intermediate 124 is generally parallel to the elongated portion 116. The leg lock 43 associated with the offset portion 118 is coupled to the intermediate portion 124.

The corner portion 119 is located in one of the corner regions 40 of the table top 12 and extends along two sides 41 of the table top 12. The corner portion 119 has a generally straight first portion 126, a generally straight second portion 128, and a curved portion 130. The first portion 126 is generally parallel to the elongated portion 116 and extends from the second transition portion 122 to the curved portion 130. The curved portion 130 extends from the first portion 126 to the second portion 128. The second portion 128 extends from the curved portion 130 toward the elongated portion 116 of an adjacent rib 108. The second portion 128 is generally parallel to the elongated portion 116 of the adjacent rib 108 and cooperates therewith to provide one of the access openings 114.

The inner stiffening rib arrangement 106 includes a central generally circular hub 132 and four generally straight elongated stiffening ribs 134, as shown in FIG. 2. The central hub 132 is formed to include the port 102. Each rib 134 (see also FIGS. 3 and 6) extends from the hub 132 along a diagonal of the table top 12 to one of the curved portions 130 for engagement therewith. In this way, the hub 132 and ribs 134 provide the inner stiffening rib arrangement 106 with an X-shape.

The lower shell member 28 further includes four inner panels 138, as shown in FIGS. 2, 3, and 6–8. Each panel 138 is generally planar and has a generally triangular shape. Each of the ribs 112, 134 of the outer and inner stiffening rib arrangements 104, 106 are appended to and descend (when the table 10 is upright) from one or more of the panels 138.

What is claimed is:

1. A table comprising a table top including a shell and a core, the shell being formed to include an interior region, the core being positioned in the interior region to strengthen the table top, a leg to support the table top, and a leg anchor plate coupled to the leg and embedded in the core to anchor the leg to the table top.

2. The table of claim 1, wherein the leg anchor plate includes an undulating member coupled to the leg and embedded in the core.

3. A table comprising a table top including a shell and a core, the shell being formed to include an interior region, the core being positioned in the interior region to strengthen the table top, a leg to support the table top, and a leg anchor coupled to the leg and embedded in the core to anchor the leg to the table top, wherein the leg anchor includes an undulating member coupled to the leg and embedded in the core and a first flange extending from the undulating member and embedded in the core.

4. The table of claim 3, wherein the leg anchor includes a second flange that extends from the undulating member about 90° from the first flange and is embedded in the core.

5. A table comprising a table top including a shell and a core, the shell being formed to include an interior region, the core being positioned in the interior region to strengthen the table top, a leg to support the table top, and a leg anchor coupled to the leg and embedded in the core to anchor the leg to the table top, wherein the leg anchor includes an undulating member coupled to the leg and embedded in the core, the leg anchor includes first and second flanges, the undulating member includes upper and lower walls and inner and outer walls, the upper and lower walls are generally parallel to one another, the inner and outer walls are generally parallel to one another and generally perpendicular to the upper and lower walls, a first of the inner walls is coupled to the upper wall and a first of the lower walls, a second of the inner walls is coupled to the upper wall and a second of the lower walls, a third of the inner walls is coupled to the upper wall and a third of the lower walls, a first of the outer walls is coupled to the first of the lower walls, a second of the outer walls is coupled to the second of the lower walls, a third of the outer walls is coupled to the third of the lower walls, the first and second flanges are generally parallel to the upper and lower walls, the first flange extends from the first of the outer walls, and the second flange extends from the second of the outer walls.

6. A table comprising a table top including a shell and a core, the shell being formed to include an interior region, the core being positioned in the interior region to strengthen the table top, a leg to support the table top, and a leg anchor coupled to the leg and embedded in the core to anchor the leg to the table top, wherein the leg anchor includes an undulating member coupled to the leg and embedded in the core, the undulating member includes a ridge, a larger trough extending from a first side of the ridge, and first and second smaller troughs extending from a second side of the ridge opposite to the first side and the troughs are coupled to the leg.

7. The table of claim 6, wherein the ridge has a generally inverted U-shaped cross-section and each of the troughs has a generally U-shaped cross-section.

8. The table of claim 6, wherein the ridge includes first and second end portions, the first smaller trough is coupled to the first end portion, the second smaller trough is coupled to the second end portion and is spaced apart from the first smaller trough to provide a space therebetween to receive the leg.

9. The table of claim 6, wherein the leg anchor includes a larger flange and a smaller flange, the larger flange extends from the larger trough, and the smaller flange extends from one of the smaller troughs.

10. The table of claim 9, wherein the larger flange includes a first portion and a second portion wider than the first portion, the first portion extends from the larger trough and is formed to include a smaller aperture, the second portion extends from the first portion and is formed to include a larger aperture, and the smaller flange is formed to include a larger aperture.

11. A table comprising a table top including a shell and a core, the shell being formed to include an interior region, the core being positioned in the interior region to strengthen the table top, a leg to support the table top, and a leg anchor coupled to the leg and embedded in the core to anchor the leg to the table top, wherein the leg anchor includes a flange embedded in the core and formed to include an aperture filled by the core.

12. A table comprising a table top including a shell and a core, the shell being formed to include an interior region, the core being positioned in the interior region to strengthen the table top, a leg to support the table top, and means for anchoring the leg to the table top, the anchoring means being coupled to the leg and embedded in the core.

13. The table of claim 12, wherein the anchoring means is a plate.

14. The table of claim 12, wherein the anchoring means includes an undulating member and first and second flanges extending from the undulating member, the undulating member and the flanges are embedded in the core, and the undulating member is coupled to the leg.

15. The table of claim 14, wherein the shell is formed to include a recessed portion receiving a portion of the leg, the undulating member mates with the recessed portion and is formed to include a channel filled by the core, and each of the first and second flanges is formed to include an aperture for material of the core to flow therethrough during assembly of the table top.

16. A table comprising a table top including a shell and a core, the shell including an upper shell member and a monolithic lower shell member cooperating with the upper shell member to provide an interior region, the core being positioned in the interior region to strengthen the table top, the lower shell member providing an underside of the table top and including a stiffening rib arrangement and a rim coupled to the upper shell member, the stiffening rib arrangement and the rim cooperate to provide an elongated first leg-receiving channel and a first leg coupled to the table top and arranged to extend in the first leg-receiving channel, wherein the stiffening rib arrangement includes an X-shaped inner stiffening rib arrangement and an outer stiffening rib arrangement surrounding the inner stiffening rib arrangement, and the rim and the outer stiffening rib arrangement cooperate to provide the first leg-receiving channel.

17. The table of claim 16, wherein the leg receiving channel is extends between adjacent corners of the table top to receive the leg which is coupled to one of the corners.

18. The table of claim 16, wherein the outer stiffening rib arrangement is shaped generally as a quadrilateral.

19. The table of claim 16, wherein the inner stiffening rib arrangement extends toward corners of the table top.

20. A table comprising a table top including a shell and a core, the shell including an upper shell member and a monolithic lower shell member cooperating with the upper shell member to provide an interior region, the core being positioned in the interior region to strengthen the table top, the lower shell member providing an underside of the table top and including a stiffening rib arrangement and a rim coupled to the upper shell member, the stiffening rib arrangement and the rim cooperate to provide an elongated first leg-receiving channel and a first leg coupled to the table top and arranged to extend in the first leg-receiving channel, wherein the stiffening rib arrangement includes an X-shaped inner stiffening rib arrangement and an outer stiffening rib arrangement surrounding and engaging the inner stiffening rib arrangement and the rim surrounds the outer and inner stiffening rib arrangements.

21. The table of claim 20, wherein the table top is shaped as a quadrilateral so as to include four corner regions and the inner stiffening rib arrangement includes a stiffening rib extending along a diagonal of the table top toward each corner region and engaging the outer stiffening rib arrangement.

22. The table of claim 20, further comprising second, third, and fourth legs coupled to the table top, and wherein the outer stiffening rib arrangement includes first, second, third, and fourth stiffening ribs aligned longitudinally with one another so as to surround the inner stiffening rib arrangement, the first and second stiffening ribs and the rim cooperate to provide the elongated first leg-receiving channel to receive the first leg, the second and third stiffening ribs and the rim cooperate to provide an elongated second leg-receiving channel to receive the second leg, the third and fourth stiffening ribs and the rim cooperate to provide an elongated third leg-receiving channel to receive the third leg, and the first and fourth stiffening ribs and the rim cooperate to provide an elongated fourth leg-receiving channel to receive the fourth leg.

23. A table comprising a table top including a shell and a core, the shell including an upper shell member and a monolithic lower shell member cooperating with the upper shell member to provide an interior region, the core being positioned in the interior region to strengthen the table top, the lower shell member providing an underside of the table top and including a stiffening rib arrangement and a rim coupled to the upper shell member, the stiffening rib arrangement and the rim cooperate to provide an elongated first leg-receiving channel and a first leg coupled to the table top and arranged to extend in the first leg-receiving channel, wherein the stiffening rib arrangement includes first and second stiffening ribs that cooperate with the rim to provide the first leg-receiving channel, the first and second stiffening ribs are spaced apart from one another to provide an access space that opens into the first leg-receiving channel to facilitate access to the first leg through the access space.

24. The table of claim 1, wherein the leg anchor plate is generally L-shaped.

25. The table of claim 1, wherein the leg anchor plate is mounted in a corner of the table top.

* * * * *